United States Patent [19]

Orceyre

[11] 4,386,754

[45] Jun. 7, 1983

[54] DEVICE FOR CONSTRUCTING IN SITU A CONCRETE RESERVOIR

[76] Inventor: Germain C. Orceyre, Saint Poncy, 15500 Massiac, France

[21] Appl. No.: 275,329

[22] Filed: Jun. 19, 1981

[30] Foreign Application Priority Data

Jun. 20, 1980 [FR] France ..... 80 13812

[51] Int. Cl.[3] ..... E04G 11/00

[52] U.S. Cl. ..... 249/19; 249/20; 249/24; 249/192

[58] Field of Search ..... 249/19, 20, 192, 24; 264/33, 34

[56] References Cited

U.S. PATENT DOCUMENTS 1,891,160 12/1932 Jespersen ..... 264/33

*Primary Examiner*—John A. Parrish

*Attorney, Agent, or Firm*—Mason, Fenwick & Lawrence

[57] ABSTRACT

The invention relates to a device for constructing a structure constituted of a floor and vertical walls (9) in concrete, comprising an external framework (2) made up of panels erected on a lower levelled surface (1) and comprising at its upper part an outer peripheral bracket (7) and a carriage (12) capable of being moved and guided along the said peripheral bracket, the said carriage forming a movable frame for removable casting components (15).

Application to the field of construction and civil engineering.

7 Claims, 7 Drawing Figures

DEVICE FOR CONSTRUCTING IN SITU A CONCRETE RESERVOIR

The present invention relates to a device for constructing in a simple manner a concrete structure comprising at least a floor and lateral walls.

It is known that, to erect for example a cylindrical or polygonal concrete reservoir, a floor is first made on a levelled surface, the latter being constituted by the floor itself treated in an appropriate manner, or by a surface belonging to a pre-constructed structure. Then, by means of a framework with two walls, an inside wall and an outside wall, a space is created in which is generally placed a metallic reinforcement then the concrete of the lateral walls of the reservoir is poured.

The invention relates to a simple, economical and rapid solution to be used for constructing the floor and the lateral walls of a reservoir which consists in a special framework designed to reduce the mounting and dismantling operations to a minimum. Said special framework is combined with a number of accessories which form therewith the device according to the invention.

The invention has therefore for its object a device characteristic in that it comprises an external framework constituted by panels, erected on a lower levelled surface and comprising at its upper part an outer peripheral bracket, and a carriage able to be moved and guided along the said peripheral bracket, the said carriage forming a mobile frame for removable casting components.

To construct the floor of the structure, one of the said removable components is constituted by an arm attached by its upper part to the said carriage and comprising a part shaped as a vertical cradle running along the internal face of the framework and having in its lower part a horizontal crossbar adjustable to any position along the cradle and forming a support for the end of the spirit level ruler at the floor base.

In addition, a support will have been provided which is designed to be embedded in the floor and centered on the axis of symmetry of the framework and comprising a pivoting axis for the other end of the aforesaid ruler.

After the construction of the floor and to erect the lateral walls, the device according to the invention further comprises an internal framework made up of panels, equipped close to its base, with adjustable thrusts protruding on the outside of the internal framework to determine the thickness of the wall of the structure and which are retractable towards the centre of the latter.

It is then advantageous for one of the panels constituting the said internal framework to be of adjustable width by means of a mobile vertical edge and comprising an outer covering plate of the mobile vertical edge and of the edge adjacent the said mobile edge.

Moreover, an internal lateral platform can be placed along the aforesaid internal framework. To construct the walls, the said arm on the carriage will have been replaced by another removable casting component constituted by a bucket jointed to the said carriage able to be discharged laterally by being pivoted about its pivoting axis.

In this embodiment, the carriage can comprise a lateral plate fixed with respect to the bucket, which constitutes the component of closing and adjusting of the discharge outlet of the bucket.

The invention will be more readily understood on reading the following description given by way of indication and non-restrictively, from which the secondary characteristics and advantages will emerge.

Reference will be made to the accompanying drawings in which.

Figure 1:
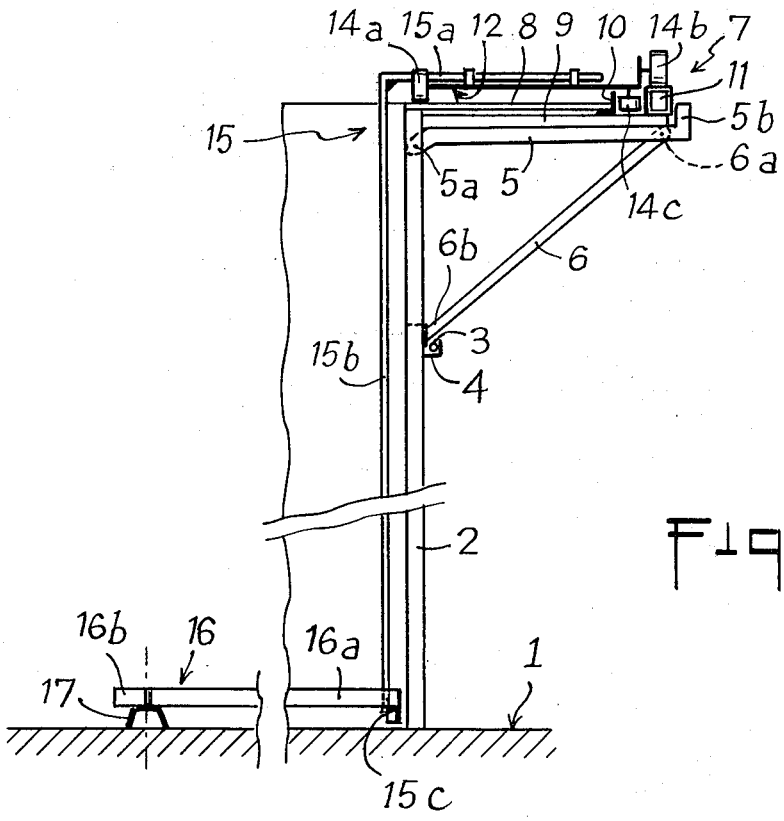
FIG. 1 is a diagrammatical partial view of the device according to the invention for constructing the floor of a structure, for example the bed of a reservoir.

Referring first of all to FIG. 1, there is seen, on a levelled surface 1 (such as for example the ground prepared by a layer of concrete or an upper surface of a pre-constructed structure), a framework 2 seen in cross-section. Said framework is constituted by a juxtaposition of panels or forms which will be bent if the framework is cylindrical. Said panels are assembled by means of any appropriate member (pins, bolts) and is consolidated by at least a cable 3 banding the framework. Said cable can advantageously run through a gutter 4 and one of its secondary functions will be explained subsequently.

The said panels or forms are constituted in known manner by sheets or plates of metal or hardboard or of any other appropriate material, fixed on a frame which is shaped and chequered with stiffening angle-irons.

Each panel has at least one arm 5 hinged at its upper part in **5*a* and kept substantially horizontal by a strut 6 hinged by its end 6*a* on the arm 5 and resting by its end 6*b* on a horizontal stiffening iron of the panel by means of a complementary iron. Thus, the horizontal wing of said complementary iron which equips the end 6*b* of the strut 6 rests on the horizontal iron of the panel, whereas the vertical flange of said complementary iron extends to the level of the gutter 4 and can be firmly held back by the banding cable 3** against the form.

Figure 2:
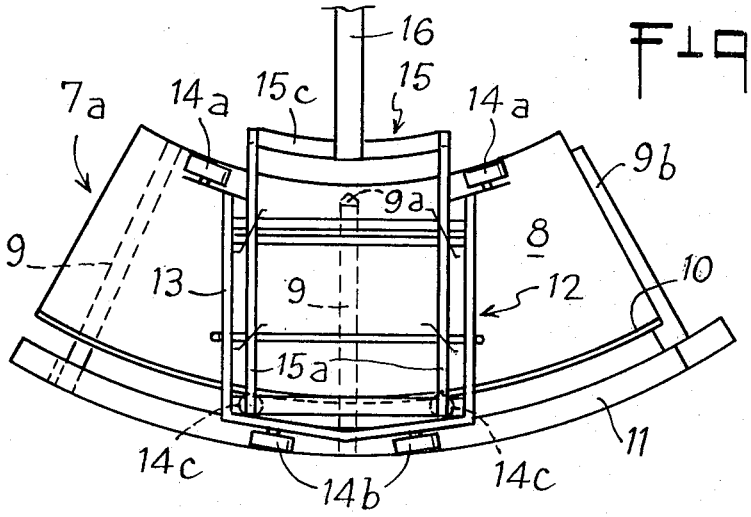
FIG. 2 is a partial view from above of FIG. 1 and illustrate an element constituting the external running bracket of the carriage.

The said arms 5 thus constitute foldable supports for a peripheral bracket 7 constituted by sectors (if the framework is cylindrical) or by sections **7*a* (see FIG. 2). Each one of the said sectors 7*a* is constituted by a sheet 8 resting and fixed on an appropriate frame of which frame are shown radial elements 9, an internal peripheral border 10 constituted by a corner iron and an external peripheral element 11 constituted for example by a square or rectangular section iron. The vertical flange of the corner iron 10 and the vertical wall facing the framework of the section iron 11 form the lateral walls of a guiding rail whose function will be explained hereinafter. The central element 9 supporting the sheet 8 is provided with an internal end 9*a* shaped so as to constitute an indexing finger of the bracket sector 7*a* on the form, by cooperating with a corresponding orifice provided at the upper end of the latter. It will have been noted in FIG. 1 that the arm 5 has a vertical end 5*b* which extends on the outside of the bracket 7, which as a result constitutes an element radially holding the latter and can also be used as a plug-in member for a removable safety fence encircling the bracket. Moreover, it should be noted that the sheet 8 extends towards the central axis of the framework so as to cover up the top of the forms. Finally, it will be noted in FIG. 2 that one of the radial elements 9b bordering laterally the sector 7a overlaps so as to constitute a resting surface for the adjacent sector. The section iron 11 will be cut at each of its ends in complementary manner one with respect to the other so that no solution of continuity appears in the completed bracket. In the case where only one arm 5 is provided by form, said arm will be placed so as to support the sections in the vicinity of the element 9b, each section 7a being then supported by one arm 5 at one of its ends, by the overlapping portion of the element 9b of the adjacent bracket at its other end, and by the stud 9a** cooperating with the form in its median part.

Such a bracket 7 is thus adapted to receive a carriage 12 which is constituted by a substantially plane tubular chassis 13 provided with rolling elements 14a on the internal edge of the bracket, with rolling elements 14b on the upper surface of the section iron 11 and with runners 14c to guide said chassis and placed between the walls of the rails defined hereinbefore. Said carriage, which can thus describe the entire bracket 7 by being guided thereon, constitutes a support for accessory casting components to construct on the one hand the bed of the reservoir and on the other hand the lateral walls of the latter.

To construct the said bed, the carriage 12 (FIGS. 1 and 2) is equipped with an arm 15 the upper part 15a of which is fixed to the chassis 13, and the other part of which extends vertically along the framework 2 and forms with a basic crossbar 15c a support for the end 16a of a spirit-level ruler 16. The crossbar 15c can be adjusted in height along the vertical part 15b depending on the thickness required for the bed. The other end 16b of the ruler can pivot about a vertical axis carried by a centering and supporting element 17 designed to be embedded in the said bed. Said element 17 is of course placed at the centre of the floor of the reservoir.

To construct the bed, some concrete is then poured on the bottom of the space inside the framework 2 in small quantities, after the necessary reinforcement has been set in, and it is spread roughly by hand, and levelled by means of the ruler 16 by causing the latter to pivot over an amplitude corresponding to the length of the crossbar 15c. At the same time, the concrete is vibrated and on this point it is noted that the ruler 16 can be a vibrating ruler or equipped with a vibrating spud. The sector situated under the ruler being levelled and vibrated, the carriage 12 is advanced of an angular value corresponding to said sector and it is proceeded in the same way to level the adjacent sector. Thus is constructed a bed which is either perfectly plane or conical, the taper point down or up depending on the adjustment of the ruler.

Figure 3:
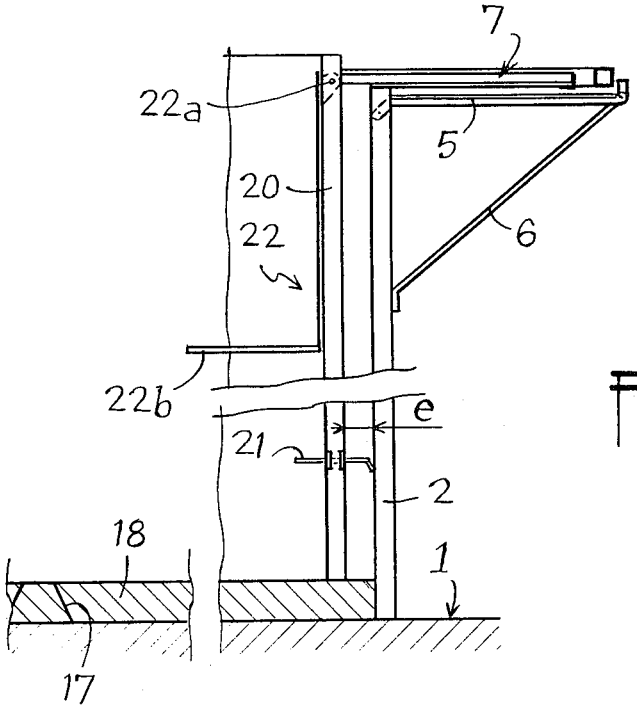
FIG. 3 illustrates the device according to the invention to construct the walls of the reservoir.

When the bed 18 (FIG. 3) is completed and sufficiently set, after removing the arm 15 and the ruler 16, it is proceeded to the fitting of the internal framework 20, which is likewise constituted of forms or panels assembled one to the other. Said internal framework 20 is equipped close to its base with a bracing thrust 21 whose length protruding outside the internal framework is adjustable (in relation to the thickness e of the walls to be constructed) and which is retractable inside the reservoir after a certain height of concrete has been cast.

The forms constituting the internal framework 20 comprise supports 22 hinged in 22a at their upper part and comprising a horizontal part 22b capable of supporting an internal platform running all around and inside the framework 20.

Figure 4:
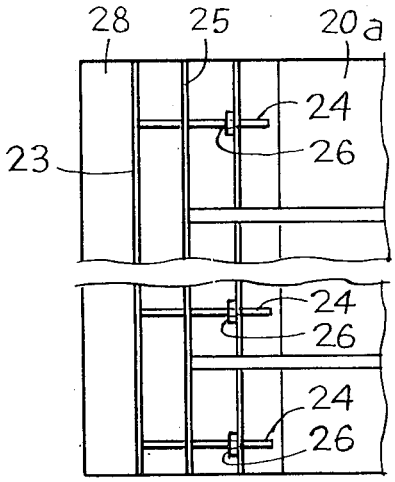
FIGS. 4 and 4A illustrate a form of the internal framework which is extensible widthwise.
Figure 4A:
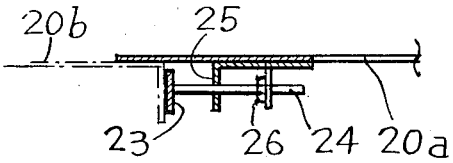

In FIGS. 4 and 4a, is diagrammatically illustrated one of the forms 20a of the framework 20, which is special in that it comprises a lateral edge 23 movable by means of threaded rods 24 integral with said edge, guided in translation in a corner-iron 25 and cooperating with nuts 26 which, when operated in rotation, permit to move the edge 23 apart from a fixed element 27 of the form 20a. By pushing thus the edge 23 against the adjacent edge of the next form 20b, all the forms are buttressed together and a good stability of the internal framework is ensured against the pressure of the cast concrete. It will finally be noted that a sheet 25 integral with the form 20a covers the range of mobility of the edge 23 and covers up the edge of the form 20b whilst being able to slide therein. Said sheet 28 ensures the tightness of the framework in that particular spot.

Figure 5A:
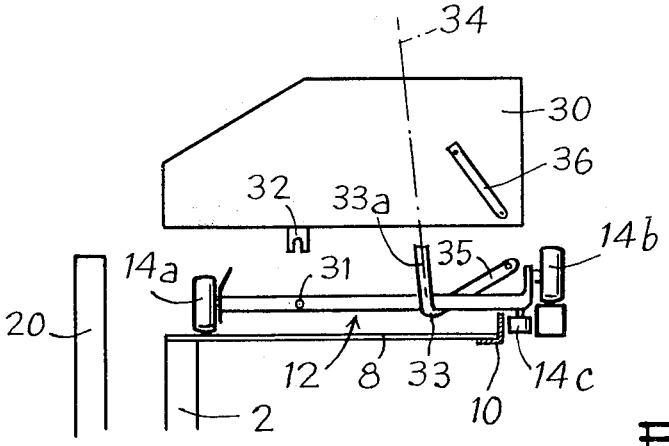
FIGS. 5A and 5B are diagrammatical views in profile of the carriage according to the invention equipped with its bucket.
Figure 5B:
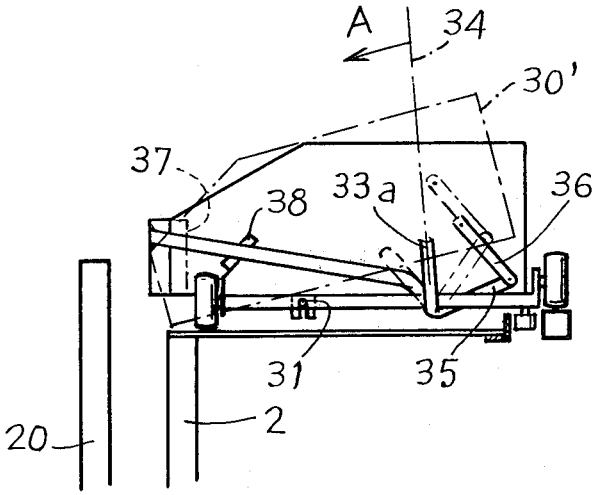

Finally, the FIGS. 5A and 5B show the carriage 12 equipped with another casting component, namely a bucket 30. In said figures, are also found some of the elements already described bearing the same references. To receive the said bucket, the carriage 12 is equipped with a longitudinal axis or hinged pin 31 adapted to be straddled by cradles 32 placed under the bottom of the bucket. Said cradles thus cooperate with the hinged pin 31 which constitutes a pivoting axis about which the bucket 30 can pivot sideways, as indicated in broken lines 30' in FIG. 5B. It is thus possible to pour its contents between the two frameworks 2 and 20, the bucket 30 being shaped so as to present no lateral wall on the side of the frameworks.

The pivoting movement of the bucket is controlled by a hinged arm system comprising an axis 33 parallel to the pin 31 mounted for rotation on the chassis of the carriage and having a bent end 33a which permits the positioning by fitting in a lever 34. A first arm 35 is fast in rotation with the lever 34 by one of its ends. The other end is adapted to be hinged on one end of a second arm 36 of which the second end is hinged to the rear part of the bucket. Thus, by actuating the lever 34 in the direction A (FIG. 5B), the angle at the top of the compass formed by the arms 35 and 36 is caused to open, and as a result the rear transversal portion of the bucket is raised, hence the pivoting of the bucket about the pin 31.

It will finally be noted in FIG. 5B the presence of a closure plate 37 for closing the discharge outlet of the bucket. Said plate 37 is added to the chassis of the carriage 12 by means of securing members 38. Stationary with respect to the carriage, it closes the discharge outlet of the bucket when the latter is not inclined. The inclination causes a lowering of the front edge of the bottom of the bucket with respect to the lower edge of the plate 37 and both edges define the opening section which is variable in relation to the inclination given to the bucket. By this very simple means, it is possible to obtain a substantially constant rate of pouring.

To proceed to the erection of the lateral walls of the reservoir, successive unloadings of the bucket are effected into the space included between the two frameworks, equipped beforehand with the appropriate reinforcement. Each unloading is carried out by tilting the bucket simultaneously to a movement of the carriage over a given sector of bracket, pre-determined by experience as a function of the rate of discharge obtained. The quantity of concrete discharged is then vibrated by an operator working on the internal platform (see FIG.

3) and the casting continues in this way by winding stages. When the filling up has reached a predetermined height (for example 40 centimeters), the thrusts 21 are retracted. Removable braces will in fact have been provided at the upper part of the framework (not shown in the Figures). The quantity of concrete already poured in is sufficient to hold the frameworks in position at their base. The casting then continues in a winding manner until completion.

The device according to the invention permits the construction of a reservoir or of a vat in a very short time. The reservoir produced this way is also perfectly tight, rough cast and requires no internal or external finishing (coating). Finally, the labour necessary for the construction is reduced to a minimum.

The invention finds an interesting application in the field of civil engineering and in particular in the construction of cylindrical structures in reinforced concrete.

It is not limited to the description given hereinabove but on the contrary covers all the variants that could be brought thereto without departing from its scope or its spirit. For example, it is possible to provide several superimposed heights of cylindrical frameworks with or without intermediate slab.

I claim:

1. Apparatus for constructing a concrete tank-like structure having a floor and vertical walls, said apparatus comprising an external framework supported on a lower level surface and including outer peripheral panels, an upper outwardly extending external peripheral bracket mounted on said external framework, a carriage mounted for movement on and along said external peripheral bracket and arm means extending downwardly from an inner side of said carriage for supporting floor forming and smoothing means on its lower end.

2. Apparatus as recited in claim 1 wherein said arm has an upper end connected to said carriage and further including a horizontal cross-bar vertically adjustably attached to the lower end of said arm and an elongated spirit-level ruler comprising the floor forming and smoothing means having one end connected to said horizontal cross-bar and having an opposite end connected to a pivotal centering element for supporting said opposite end.

3. Apparatus as claimed in claim 2 wherein said pivotal centering element is embedded in the supporting surface and is centered on an axis of symmetry of the external framework.

4. Apparatus as claimed in claim 1 wherein said framework further includes an internal framework supporting wall forming panels between which wall forming concrete is poured and additionally including means for adjusting the spacing between said wall forming panel so as to provide a formed wall of desired thickness.

5. Apparatus as set forth in claim 4 wherein one of the wall-forming panels includes a mobile vertical edge portion movable horizontally to overlap an adjacent panel.

6. Apparatus as recited in claim 4 additionally including an internal lateral platform attached to the internal framework.

7. Apparatus as recited in claim 1 additionally including a bucket hingedly mounted on the carriage for pivotal movement about a horizontal axis so as to be capable of discharging the contents of the bucket laterally into the wall area of the concrete tank-like structure being formed.

* * * * *